US005756218A

United States Patent [19]

Buchheit et al.

[11] Patent Number: 5,756,218

[45] Date of Patent: May 26, 1998

[54] CORROSION PROTECTIVE COATING FOR METALLIC MATERIALS

[75] Inventors: Rudolph G. Buchheit; Michael A. Martinez, both of Albuquerque, N. Mex.

[73] Assignee: Sandia Corporation, Albuquerque, N. Mex.

[21] Appl. No.: 781,784

[22] Filed: Jan. 9, 1997

[51] Int. Cl.[6] ..... B32B 15/00; B05D 3/10; B05D 1/02; B05D 1/38

[52] U.S. Cl. ..... 428/469; 427/327; 427/328; 427/383.7; 427/435; 427/429; 427/421; 427/419.8; 428/457

[58] Field of Search ..... 427/299, 327, 427/328, 329, 320, 321, 383.7, 436, 438, 435, 429, 421, 419.8; 428/469, 457

[56] References Cited

U.S. PATENT DOCUMENTS

| | | | |
|---|---|---|---|
| 3,864,230 | 2/1975 | Springer et al. | 204/181 |
| 3,964,936 | 6/1976 | Das | 148/6.27 |
| 3,985,585 | 10/1976 | Tuttle et al. | 148/6.27 |
| 4,004,951 | 1/1977 | Dorey, Jr. | 428/470 |
| 4,054,466 | 10/1977 | King et al. | 148/247 |
| 4,063,969 | 12/1977 | Howell, Jr. | 148/274 |
| 5,266,356 | 11/1993 | Buchheit, Jr. et al. | 427/372.2 |
| 5,346,560 | 9/1994 | Mournet et al. | 148/217 |
| 5,401,337 | 3/1995 | Carlsn et al. | 148/257 |
| 5,551,994 | 9/1996 | Schriever | 148/273 |

OTHER PUBLICATIONS

A. Csanady, T. Turmezey, I. Imre-Baan, A. Briger, D. Marton, L. Fodor and L. Vitalis, *The Relationship Between the Corrosion Resistance and Impurity Content of Aluminum Oxide Layers*, Corrosion Science, vol. 24, No. 3, pp. 237–248, 1984.

*Primary Examiner*—Shrive Beck
*Assistant Examiner*—Michael Barr
*Attorney, Agent, or Firm*—Elmer A. Klavetter

[57] ABSTRACT

Corrosion protective coatings for metallic materials, particularly aluminum and aluminum alloys, produced with simple, low-cost equipment and materials other than toxic metals or metal salts, or metal cyanides. The metallic material is cleaned, degreased, and deoxidized, the surface is converted to a substantially alkaline condition, and the surface is chemically sealed with inorganic metal compounds.

33 Claims, 1 Drawing Sheet

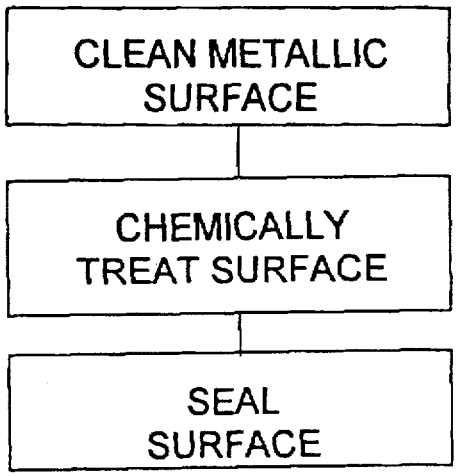
CLEAN METALLIC SURFACE
CHEMICALLY TREAT SURFACE
SEAL SURFACE

CORROSION PROTECTIVE COATING FOR METALLIC MATERIALS

This invention was made with Government support under Contract No. DE-AC04-94AL85000 awarded by the United States Department of Energy. The Government has certain rights in the invention.

BACKGROUND OF THE INVENTION

This invention relates generally to the application to the surfaces of metals and alloys, particularly aluminum and aluminum alloys, coatings with desirable properties using simple, low-cost equipment and materials other than toxic metals, metal salts, or metal cyanides.

Metallic surfaces are often protected from corrosion by the application of a barrier coating. A first type of barrier coating is anodic oxides usually formed by an electrochemical means (anodizing) while the metal is immersed in an inorganic acid such as $H_2SO_4$ or $H_3PO_4$. Anodic oxides have a wide range of thicknesses and porosities. Porous coatings can be sealed in steam, boiling water, or various salt solutions. A second type is ceramics, usually special cements applied to a metal to prevent corrosion. A common example of a ceramic coating is porcelain enamel. A third type is molecular barriers formed by the addition of organic molecules to solution. Effective inhibitors are transported to the metal-solution interface and have a reactive group attached to a hydrocarbon. The reactive group interacts with the metal surface while the hydrocarbon group is exposed to the environment. As the molecules form the molecular barrier coating, corrosion reactions are slowed. A fourth type is organic material generally intended to prevent interaction of an aggressive environment with the metal surface. Organic coatings are the most widely used barrier coatings for metals, and paint is a typical example. A fifth type is the conversion coating made by converting some of the base metal into a protective oxide. Chromate and phosphate coatings are the two most common kinds of conversion coatings.

Chromate and phosphate conversion coatings can be formed by chemical and electrochemical treatment of a metal or alloy material during immersion in a solution containing hexavalent chromium ($Cr^{+6}$), phosphorous as a phosphate anion, and usually other components. Literally hundreds of subtly different, proprietary chromate-conversion coating formulas exist. For aluminum and aluminum alloys, the primary active ingredient in the bath is usually a chromate, dichromate ($CrO_4^{-2}$ or $Cr_2O_7^{-2}$), or phosphate ($PO_4^{-3}$). The pH of the solution is usually in the range of 1.3–2.5, but a few alkaline bath formulas are known. The process results in the formation of a protective, amorphous coating comprised of oxides of the substrate, complex chromium or phosphorous compounds, and other components of the processing solution. Only a small number of coatings and chromating processes have been characterized by surface analysis techniques, but in coating systems that have been studied the following compounds have been reported: substrate oxides and hydroxides such as $Al_2O_3$ and $Al(OH)_3$, chromium oxides and hydroxides such as $Cr_2O_3$, CrOOH, $Cr(OH)_3$, and $Cr_2O_3 \bullet_{\psi} H_2O$, and phosphates such as $AlPO_4$. These coatings enhance corrosion resistance of bare and painted surfaces, improve adhesion of paint or other organic finishes, or provide the surface with a decorative finish.

Chromate conversion coatings are applied by contacting the processed surfaces with a sequence of solutions. The basic processing sequence typically comprises the following six steps: cleaning the metal surface, rinsing, creating the conversion coating on the metal surface, rinsing, post-treatment rinsing, and drying. The cleaning, rinsing, and drying steps are standard procedures throughout the industry. The chief variant among the processes used is the composition of the chromate conversion solution. The compositions of these solutions depends on the metal to be treated and the specific requirements of the final product. The chief disadvantage of chromate-conversion coating processes is that they involve the use of hazardous substances.

Because of the environmental problems with chromates, much work has been done to develop protective coatings which do not employ such compounds. For example, U.S. Pat. No. 4,004,951 (Dorsey) discloses applying a hydrophobic coating to an aluminum surface by treatment with a long-chain carboxylic acid and an equivalent alkali metal salt of the carboxylic acid; U.S. Pat. No. 4,054,466 (King et al.) discloses a process for the treatment of aluminum in which vegetable tannin is applied to the surface of the aluminum; and U.S. Pat. No. 4,063,969 (Howell et al.) discloses treating aluminum with a combination of tannin and lithium hydroxide. In each of the above patents, the primary protective ingredient is the complex organic compound, the treatment solution is applied at slightly elevated temperatures (90°–125° F.), and the treatment solution is kept at a mid-level pH (4–8 in King et al. and Howell et al., and 8–10 in Dorsey).

Csanady et al. in *Corrosion Science*, 24, 3, 237–248 (1984) shows that alkali and alkali earth metals stimulated $Al(OH)_3$ growth on aluminum alloys. However, Csanady et al. reports that the incorporation of $Li^+$ or $Mg^+$ into a growing oxide film degrades corrosion resistance.

U.S. Pat. No. 5,266,356 (Buchheit et al.) discloses the corrosion protection of aluminum and aluminum alloys by immersion in an alkaline lithium or alkaline magnesium salt solution causing the formation of a protective film on the surface which includes hydrotalcite compounds. Only alkaline lithium or magnesium salt solutions are disclosed, and no beneficial sealing of the protective film by means of a sealing solution, with or without an oxidizing agent, is disclosed.

SUMMARY OF THE INVENTION

It is an object of this invention to provide a process for forming a corrosion resistant oxide coating on metals and alloys, particularly aluminum and aluminum alloys, using simple, low-cost equipment, and no toxic materials such as chromium, chromium salts, or metal cyanides.

It is a further object of this invention to treat metals and alloys to place their surfaces in a substantially alkaline condition, and then seal their surfaces by contact with an aqueous solution containing one or more soluble metal compounds.

It is a still further object of this invention to precipitate a metal compound or compounds from an aqueous solution, containing one or more soluble metal compounds, that has a neutral or slightly acidic pH onto, and into, the metallic surface to provide corrosion resistance.

It is a still further object of this invention to add an oxidizing agent to the seal-forming aqueous solution, containing one or more soluble metal compounds, in sufficient quantity to oxidize the solution cation or cations to a higher valence state.

BRIEF DESCRIPTION OF THE DRAWING

The drawing shows in sequence the three basic steps of the process whereby a corrosion-protective coating is applied to the surface of a metallic material.

DETAILED DESCRIPTION OF THE INVENTION

The present invention provides a process for the formation of coatings with desirable properties on surfaces of metals or alloys, particularly aluminum or aluminum alloys, using simple, low-cost equipment, and no toxic materials such as chromium, chromium salts, or metal cyanides. This method exploits formation of a substantially alkaline condition on the metal or alloy surface, followed by precipitation of insoluble metal oxides and hydroxides into and onto the film.

For example, corrosion-resistant films can be formed on aluminum and aluminum alloys using a multi-step process involving immersion in an alkaline lithium-salt solution. Corrosion resistance may be enhanced by a subsequent heat treatment and room-temperature aging process.

Components to be coated are first degreased with hexane or other suitable degreasing agent. The components are then cleaned in an alkaline bath, the residue from the cleaning process is removed in a deoxidizing acid bath, and the components are rinsed in water.

The components are then immediately immersed in an alkaline lithium-salt solution. For example, the solution may be about 0.01–0.6M $Li_2CO_3$. The best results have been achieved with alkaline lithium-salt solutions with concentrations ranging about 0.05–0.1M. The pH of the solution must be greater than 8, preferably about 11–12. The components remain in the alkaline lithium-salt solution about 5–60 minutes, or longer for thicker coatings. The solution may be maintained at room temperature during immersion, after which the components are removed and dried. The components may then be heat treated, or after a subsequent sealing process. For example, heating in air at about 30°–200° C. for about 5–240 min yields desirable results. Coatings formed by this process are thin and translucent. The appearance of these coatings is similar to that produced by some conversion coatings, and the corrosion resistance is comparable to some chromate-conversion coatings in accelerated testing.

The hydrothermal species formed on an aluminum surface during immersion has a structure comprised of layers of hydroxide ions separated by alternating layers of Al and Li cations, or Al and Mg cations, and anions of the salt in solution. The species belongs to a class of clays known as hydrotalcites which can, without further processing, impart corrosion resistance to the aluminum. However, the protective properties of the hydrotalcite film may degrade in acid and neutral solutions. Therefore, a post-film formation heat treatment has been found to be beneficial in improving corrosion resistance. Heat treatment is believed to liberate water and volatile anions bound in the hydrotalcite structure to create a more corrosion-resistant film. Titanium salts, hydrofluoric acid, phosphoric acid, and sodium hydroxide may be advantageously added to the alkaline lithium-salt solution to improve the characteristics of the resulting corrosion resistant film.

Hydrotalcite compounds are detectable on aluminum and aluminum alloys after immersion in solutions with a pH as low as about 8. However, increasing amounts of the hydrotalcite compounds results when the solution has a higher pH. Increased corrosion resistance has been observed in the presence of several solutions of lithium salts including LiCl, LiBr, $Li_2CO_3$, and $Li_2SO_4$, as well as LiOH. Other lithium salts and compounds should also be suitable for hydrotalcite-compound formation.

Hydrotalcite films are formed in solution at room temperature. Increasing the lithium-salt solution temperature causes species like carbonates and sulfates to escape through the formation of carbon dioxide and sulfur dioxide, thereby inhibiting hydrotalcite formation. Aluminum alloys which contain lithium at a level ranging from about 0.5–10 wt % would need only be exposed to aqueous alkaline salts having anions such as, but not limited to, $CO_3^{-2}$, $SO_4^{-2}$, $Cl^{-1}$, $Br^{-1}$, and $OH^{-1}$ since the lithium in the alloy could react with the immersion solution. The immersion time required to form the hydrotalcite compounds in the protective film depends on the alloy type, compound concentration and type, and bath pH.

For less corrosion-resistant substrates, including 2024-T3 and 7075-T6 aluminum alloys, the hydrotalcite coating should be exposed to an aqueous neutral or acid metal-salt solution. This seals any latent porosity in the coating by precipitating metal oxide into the pores. This process is analogous to dichromate sealing of sulfuric-acid anodized aluminum, except that external electrolytic control is not required, and the sealing can be done in a very short time. The corrosion resistance of such a sealed hydrotalcite coating is comparable to that of chromate-conversion coatings.

The metal salts used in the sealing process can be divided into two sets. The first comprises salts whose solubility minimum occurs under alkaline-solution conditions; this includes salts of Ce, Co, Ni, Fe, Mn, and Mg. The second set comprises salts that are potential inorganic sealants for oxide coatings; this includes salts of Mo, Bi, Al, and Cr.

A preferred embodiment of the invention comprises:

a) cleaning the metal or alloy surface in an aqueous detergent solution, rinsing in deionized water, degreasing the surface in an alkaline silicate/carbonate solution held at elevated temperature, rinsing in deionized water, deoxidizing the surface by immersion in an acid solution typically containing nitric and/or hydrofluoric acid, and rinsing again in deionized water;

b) growing a hydrothermal coating, by chemical treatment, on the metal or alloy by immersion for about 60–180 min in an aqueous solution that contains a soluble lithium salt together with: 1) a soluble aluminum salt if aluminum or an aluminum alloy is to be protected; or 2) a soluble magnesium salt if magnesium or a magnesium alloy is to be protected. Examples of suitable lithium salts are lithium nitrate, lithium carbonate, lithium chloride, as well as lithium hydroxide. Examples of suitable aluminum salts are sodium aluminate, potassium aluminate, aluminum chloride, and aluminum nitrate. The lithium-salt concentration is in the range of about 100 ppm by weight to the solubility limit of the particular compound, typically about 0.1–1.0M. An aluminum-salt concentration is typically in the range of about 10 ppm by weight to about 0.3M. The solution pH is about 8–14, and the temperature of the solution ranges from about 20°–100° C.; or c) as an alternative to immersion in part (b), growing the hydrothermal coating by spraying (where the contact time is about 1–30 min), brushing (where the contact time is about 1–15 min), or rolling (where the contact time is about 1–5 min) the aqueous salt solution onto the metal or alloy surface;

d) sealing the unrinsed hydrothermal coating by immersion in an aqueous solution of a soluble metal compound or compounds comprised primarily, though not exclusively, of metal compounds that have low solubility under alkaline conditions. The cations of the metal salts may include one or more of the group consisting of: Al, Mg, Ca, Sr, Ti, Mo, Ce, Pr, Nd, Sm, Eu, Gd, Tb, Dy, Ho, Er, Tm, Yb, Lu, Mn, Fe, Co, Ni, and Bi. The temperature of the bath is about 20°–100° C. Immersion is followed by rinsing with deionized water; or e) as alternatives to immersion in part (d), sealing the unrinsed hydrothermal coating by spraying, brushing, or rolling (where the contact times are about 1–5 min) the aqueous solution of a soluble metal compound or compounds onto the coated metal or alloy surface, and rinsing with deionized water; or f) allowing the unrinsed hydrothermal coating to dry first, and then sealing it by the method of (d), except that the immersion time is about 1–15 min followed by rinsing with deionized water; or g) as an alternative to immersion in (f), allowing the unrinsed hydrothermal coating to dry first, and then sealing it by spraying (where the contact time is about 5–60 sec), brushing (where the contact time is about 0.1–5 min), or rolling (where the contact time is about 5–300 sec) the aqueous solution of a soluble metal compound or compounds onto the coated metal or alloy surface, and rinsing with deionized water; and h) optionally, adding an oxidizing agent such as hydrogen peroxide to the aqueous metal-salt sealing solutions of (d), (e), (f), and (g) in sufficient quantity to oxidize the solution cation to a higher valence state. An example is the addition of about 5 ml of hydrogen peroxide to 1 liter of sealing solution.

Tables 1 and 2 show the respective corrosion resistances of 6061 -T6 and 2024-T3 aluminum alloys coated with a hydrothermal lithium-aluminum coating and sealed by exposure to different metal-salt solutions. The coated and sealed samples were exposed to an aerated 0.5M NaCl solution for 24±1 h under free corrosion conditions. An electrochemical impedance spectroscopy test was then conducted by applying a 10-mV sinusoidal voltage perturbation at frequencies ranging about 10 kHz-10 mHz. The data obtained were then analyzed by complex, non-linear, least-squares regression to an equivalent circuit model consisting of a constant-phase element in parallel with a resistance. This parallel-circuit element combination is in series with a solution resistance. The values shown in Tables 1 and 2 are the values of the polarization resistance obtained thereby. The polarization resistance has been shown to be an accurate measure of corrosion protection provided by chemically passivated aluminum alloys—the larger the resistance, the greater the protection. For comparison, uncoated aluminum alloys subjected to this test typically yield polarization resistances of about $1\times10^3$–$5\times10^3$ ohm-cm$^2$.

TABLE 1

| Metal Type of Oxide Sealant | Polarization Resistance (ohm-cm$^2$) |
|---|---|
| Bi | $4.17 \times 10^5$ |
| Ce | $6.83 \times 10^5$ |
| Ni | $9.12 \times 10^5$ |
| Mo | $1.05 \times 10^6$ |
| Al | $1.50 \times 10^6$–$1 \times 10^8$ |
| Mg | $1.51 \times 10^8$ |
| Mn | $1.82 \times 10^6$ |
| Co | $3.55 \times 10^6$ |

TABLE 2

| Metal Type of Oxide Sealant | Polarization Resistance (ohm-cm$^2$) |
|---|---|
| Mo | $4.50 \times 10^4$ |
| Mg | $4.57 \times 10^4$ |

TABLE 2-continued

| Metal Type of Oxide Sealant | Polarization Resistance (ohm-cm$^2$) |
|---|---|
| Bi | $6.31 \times 10^4$ |
| Mn | $2.29 \times 10^5$ |
| Ce | $8.13 \times 10^5$–$2.10 \times 10^7$ |
| Co | $1.00 \times 10^6$ |
| Ni | $1.15 \times 10^6$ |

The examples discussed above are cited to illustrate a particular embodiment of this invention. It is contemplated that the use of the invention may involve components having different forms and compositions. It is intended that the scope of the invention be defined by the claims appended hereto.

What is claimed is:

1. A process for the corrosion protection of the surface of a metallic material comprising:

cleaning the metal surface;

forming a coating by chemically treating the metal surface with a first alkaline aqueous solution so that the surface and resulting coating are in a substantially alkaline condition; and sealing the coating without an intermediate rinsing step by contacting the coating with an aqueous solution consisting essentially of at least one soluble metal salt to cause chemical deposition of the at least one soluble metal salt on the coating.

2. The process of claim 1 wherein cleaning comprises removing bulk and molecular organic contaminants, deoxidizing the surface by immersion in an acid solution, and rinsing in water.

3. The process of claim 1 wherein the metallic material is selected from the group consisting of aluminum, aluminum alloys, magnesium, and magnesium alloys.

4. The process of claim 1 wherein the substantially alkaline condition results from the presence of a solid film containing hydrotalcite compounds.

5. The process of claim 1 wherein the substantially alkaline condition results from the presence of a liquid, alkaline film.

6. The process of claim 4 wherein the step of forming a coating by chemically treating the metal surface so that it is in a substantially alkaline condition comprises immersing the metal surface in an alkaline aqueous solution of a soluble metal compound or compounds for about 6–180 min.

7. The process of claim 4 wherein the step of forming a coating by chemically treating the metal surface so that it is in a substantially alkaline condition comprises spraying an alkaline aqueous solution of a soluble metal compound or compounds onto the surface for about 1–30 min.

8. The process of claim 4 wherein the step of forming a coating by chemically treating the metal surface so that it is in a substantially alkaline condition comprises brushing an alkaline aqueous solution of a soluble metal compound or compounds onto the surface for about 1–15 min.

9. The process of claim 4 wherein the step of forming a coating by chemically treating the metal surface so that it is in a substantially alkaline condition comprises rolling an alkaline aqueous solution of a soluble metal compound or compounds onto the surface for about 1–5 min.

10. The process of claim 5 wherein the step of forming a coating by chemically treating the metal surface so that it is in a substantially alkaline condition comprises immersing the metal surface in an alkaline aqueous solution of a soluble metal compound or compounds for about 60–180 min.

11. The process of claim 5 wherein the step of forming a coating by chemically treating the metal surface so that it is in a substantially alkaline condition comprises spraying an alkaline aqueous solution of a soluble metal compound or compounds onto the surface for about 1–30 min.

12. The process of claim 5 wherein the step of forming a coating by chemically treating the metal surface so that it is in a substantially alkaline condition comprises brushing an alkaline aqueous solution of a soluble metal compound or compounds onto the surface for about 1–15 min.

13. The process of claim 5 wherein the step of forming a coating by chemically treating the metal surface so that it is in a substantially alkaline condition comprises rolling an alkaline aqueous solution of a soluble metal compound or compounds onto the surface for about 1–5 min.

14. The process of claim 1 wherein the soluble metal salt comprises a compound containing one or more cations selected from the group consisting of Al, Mg, Ca, Sr, Ti, Mo, Ce, Pr, Nd, Sm, Eu, Gd, Tb, Dy, Ho, Er, Tm, Yb, Lu, Mn, Fe, Co, Ni, and Bi.

15. The process of claim 1 wherein the surface is unrinsed and wet before sealing.

16. The process of claim 1 wherein the surface is unrinsed and dried before sealing.

17. The process of claim 1 wherein the step of sealing the coating by contacting the coating in an aqueous solution comprises immersing the coating for about 0.1–15 min, the temperature of the solution is about 20°–100° C., and the surface is permitted to dry without rinsing.

18. The process of claim 1 wherein the step of sealing the coating by contacting the coating in an aqueous solution comprises spraying for about 5–60 sec, the temperature of the solution is about 20°–100° C., and the surface is permitted to dry without rinsing.

19. The process of claim 1 wherein the step of sealing the coating by contacting the coating in an aqueous solution comprises brushing for about 1–5 min, the temperature of the solution is about 20°–100° C., and the surface is permitted to dry without rinsing.

20. The process of claim 1 wherein the step of sealing the coating by contacting the coating in an aqueous solution comprises rolling for about 5–300 sec, the temperature of the solution is about 20°–100° C., and the surface is permitted to dry without rinsing.

21. The process of claim 1 wherein the step of sealing the coating by contacting the coating in an aqueous solution comprises immersing the coating for about 0.1–15 min, the temperature of the solution is about 20°–100° C., and the surface is rinsed with deionized water.

22. The process of claim 1 wherein the step of sealing the coating by contacting the coating in an aqueous solution comprises spraying for about 5–60 sec, the temperature of the solution is about 20°–100° C., and the surface is rinsed with deionized water.

23. The process of claim 1 wherein the step of sealing the coating by contacting the coating in an aqueous solution comprises brushing for about 1–5 min, the temperature of the solution is about 20°–100° C., and the surface is rinsed with deionized water.

24. The process of claim 1 wherein the step of sealing the coating by contacting the coating in an aqueous solution comprises rolling for about 5–300 sec, the temperature of the solution is about 20°–100° C., and the surface is rinsed with deionized water.

25. The process of claim 14 comprising the additional step of adding an oxidizing agent to the aqueous solution in sufficient quantity to oxidize solution cations to a higher valence state.

26. The process of claim 25 wherein the oxidizing agent is hydrogen peroxide at a concentration of 5000 ppm by volume in the aqueous solution.

27. The process of claim 1 further comprising the step of heat treating the metallic material at about 30°–200° C. for about 5–240 min between the steps of chemically treating and sealing the surface.

28. The process of claim 1 further comprising the step of heat treating the metallic material at about 30°–200° C. for about 5–240 min after the step of sealing the surface.

29. The product produced by the process of claim 1.

30. The product produced by the process of claim 25.

31. The product produced by the process of claim 27.

32. The product produced by the process of claim 28.

33. A process for the corrosion protection of the surface of a metallic material comprising:

cleaning the metal surface;

forming a coating by contacting the metal surface with an alkaline aqueous solution containing a soluble lithium salt so that the surface and resulting coating are in a substantially alkaline condition; and sealing the coating without an intermediate rinsing step by contacting the coating with an aqueous solution consisting essentially of at least one soluble metal salt, wherein said metal salt comprises a metal salt containing one or more cations selected from the group consisting of Al, Mg, Ca, Sr, Ti, Mo, Ce, Pr, Nd, Sm, Eu, Gd, Tb, Dy, Ho, Er, Tm, Yb, Lu, Mn, Fe, Co, Ni, and Bi.

* * * * *